United States Patent [19]

Heritage

[11] Patent Number: 4,625,470

[45] Date of Patent: Dec. 2, 1986

[54] OPENWORK SCREEN ASSEMBLY

[75] Inventor: Robert C. Heritage, London, England

[73] Assignee: Intalite International N.V., Netherlands Antilles

[21] Appl. No.: 562,191

[22] Filed: Dec. 15, 1983

[30] Foreign Application Priority Data

Dec. 17, 1982 [GB] United Kingdom ..... 8235957

[51] Int. Cl.[4] ..... E04C 2/40

[52] U.S. Cl. ..... 52/28; 52/39; 52/646; 52/645; 52/667; 52/668

[58] Field of Search ..... 52/663, 664, 667, 668, 52/645, 646, 473, 507, 28, 39

[56] References Cited

U.S. PATENT DOCUMENTS

| | | | |
|---|---|---|---|
| 2,689,026 | 9/1954 | Zingone . | |
| 2,706,314 | 4/1955 | Siering . | |
| 2,744,590 | 5/1956 | Butts | 52/645 |
| 2,857,631 | 10/1958 | Zingone . | |
| 2,905,286 | 9/1959 | Adams et al. . | |
| 3,023,861 | 3/1962 | Bak . | |
| 3,190,208 | 6/1965 | Styne et al. . | |
| 3,292,332 | 12/1966 | Jahn . | |
| 3,310,922 | 3/1967 | Hoffmann, Jr. . | |
| 3,321,882 | 5/1967 | Stahlhut . | |
| 3,627,364 | 12/1971 | Van Riet . | |
| 3,746,379 | 7/1973 | Sauer . | |
| 3,797,192 | 3/1974 | DeJonge . | |
| 4,034,534 | 7/1977 | Taylor | 52/668 |
| 4,042,991 | 8/1977 | Macy et al. | 52/645 |
| 4,227,358 | 10/1980 | Gat . | |
| 4,332,366 | 6/1982 | Munt | 52/645 |
| 4,492,066 | 1/1985 | LaLonde | 52/668 |
| 4,532,749 | 8/1985 | Perk | 52/668 |
| 4,545,165 | 10/1985 | Carey et al. | 52/668 |

FOREIGN PATENT DOCUMENTS

| | | | |
|---|---|---|---|
| 987064 | 4/1976 | Canada . | |
| 1931210 | 1/1970 | Fed. Rep. of Germany . | |
| 1961719 | 8/1970 | Fed. Rep. of Germany . | |
| 2211600 | 10/1972 | Fed. Rep. of Germany . | |
| 2207195 | 9/1973 | Fed. Rep. of Germany . | |
| 2418918 | 11/1974 | Fed. Rep. of Germany . | |
| 2390610 | 12/1978 | France . | |
| 2485592 | 12/1981 | France . | |
| 7409058 | 3/1975 | Netherlands | 52/28 |
| 7400362 | 7/1975 | Netherlands | 52/507 |
| 367670 | 4/1974 | Sweden . | |
| 7204057-9 | 7/1975 | Sweden . | |
| 799175 | 8/1958 | United Kingdom . | |
| 806982 | 1/1959 | United Kingdom . | |
| 914868 | 1/1963 | United Kingdom . | |
| 993402 | 5/1965 | United Kingdom . | |
| 1126868 | 9/1968 | United Kingdom . | |
| 1221354 | 2/1971 | United Kingdom . | |
| 1424800 | 2/1976 | United Kingdom . | |
| 1472285 | 5/1977 | United Kingdom . | |

OTHER PUBLICATIONS

ASV Danacoustic Ceilings leaflet No. 710, ASV Ardal og Sunndal Verk a.s.

6945570, West German abstract, Klasse-37, Heft 11 vom 12.3.1970, p. 595.

7144974, West German abstract, Klasse-37, Gma-Heft 8 vom 17.2.1972, p. 365.

1931313, West German abstract, Klasse-37, Heft 3 vom 20.1.1966, p. 110.

1958263, West German abstract, Klasse-37, Heft 14 vom 6.4.1967, p. 692.

1961719, West German abstract, Klasse-37, Heft 23 vom 8.6.1967, p. 1124.

*Primary Examiner*—John E. Murtagh

*Assistant Examiner*—Caroline Dennison

*Attorney, Agent, or Firm*—Wenderoth, Lind & Ponack

[57] ABSTRACT

In order to provide a pleasing aesthetic appearance, and also in order to enable concealed, directional lighting to be used, an openword grid-like suspended ceiling system has outer squares which contain four inner blades forming an inner square surrounded by four rectangles. Light fittings are associated with the rectangles to that the axis of a light fitting can be inclined. In order to enable the ceiling system to be packaged at low packing density, the four inner blades are hinged to each other and collapse so as to lie parallel to each other. After opening out, they can be hooked into the sides of the outer squares.

11 Claims, 8 Drawing Figures

FIG.4.
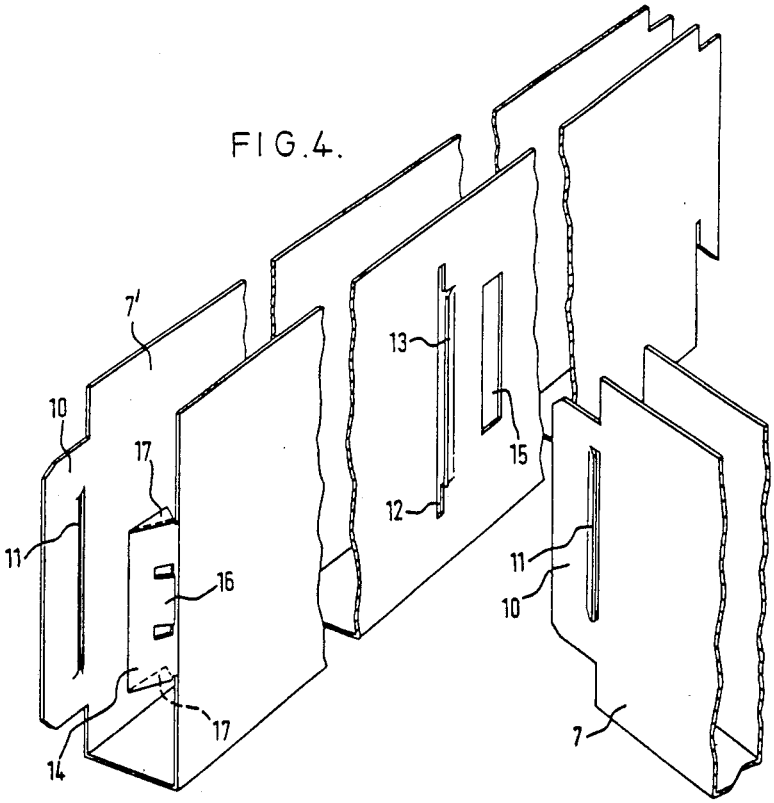
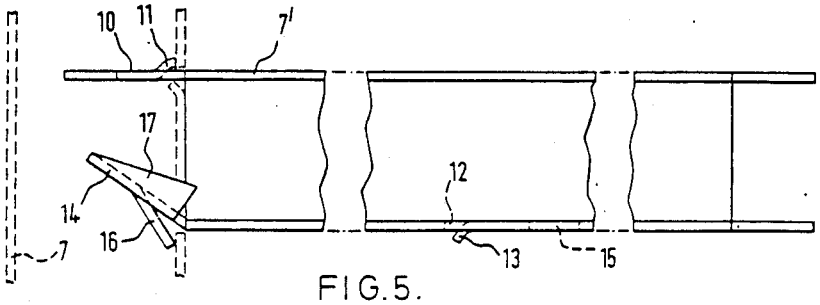
FIG.5.

OPENWORK SCREEN ASSEMBLY

BACKGROUND OF THE INVENTION

The present invention relates to an openwork screen assembly for use in a building construction. The assembly was designed principally for use in suspended ceilings (false ceilings), but the assembly could also find use when positioned vertically, as a wall screen. The assembly is formed of interconnected elongate members, which can be called ribs or blades, with spaces or open cells therebetween, and the assembly comprises a rectangle or square formed by two pairs of parallel, spaced, elongate members. Such assemblies are known, and examples are described in GB No. 1 472 285 and GB No. 8217911. In both these patent specifications, the elongate members form a repeat square pattern, in which larger openings can be formed for, for instance, light fittings. However, problems occur when providing light fittings within the pattern itself, without disturbing the pattern. Narrow beam, vertical lights, such as spot lights or accent lights, can be accommodated easily. However directional lighting is more conveniently suspended below the ceiling; the distance between the elongate members, and the height of the elongate members themselves, does not permit directional lighting to be mounted in or above the suspended ceiling in any convenient manner.

THE INVENTION

The invention provides nonbearing openwork screen assembly for use in a building construction, formed of interconnected elongate members with spaces therebetween, and comprising an outer rectangle or square formed by two pairs of parallel, spaced, outer elongate members, and, within and spaced from the sides of the outer rectangle or square, an inner, smaller rectangle or square formed by four inner elongate members, each of which has a first end meeting the next inner elongate member at a position between its ends, to form a T-like shape, and the second end meeting a side of the outer rectangle or square between its ends, the inner rectangle or square being thereby surrounded by four intermediate rectangles or squares, the first end of each inner elongate member making a hinged connection with the next inner elongate member, the inner elongate members being constructed so that they can be pre-assembled in collapsed form with all four inner elongate members generally parallel to each other and the inner rectangle or square opened up by pivoting the inner elongate members relative to one another about the hinged connections. By "nonbearing" is meant herein that the screen is capable of light support such as would be expected of a false ceiling on nonbearing wall for supporting such items as light fixtures, but is incapable of providing heavy support as would be expected of a true ceiling on a bearing wall. Preferably, the hinged connection is formed by at least one projecting hinge tab on said first end of the inner elongate member, the hinge tab being retained in a slot in the next inner elongate member. Intermediate its top and bottom and on its outer side, the hinge tab may have a bent-out sprag, directed generally towards the other end of the inner elongate member, to retain the hinge tab in the slot. The inner elongate members may be constructed so that they can be collapsed with all four inner elongate members substantially parallel, two opposite inner elongate members being aligned and the other two opposite inner elongate members being on either side of the aligned inner elongate members and overlapping each of them. The said first end of the inner elongate member may make a hinged connection with substantially the midpoint of the next inner elongate member, thereby forming an inner square surrounded by intermediate rectangles having a width substantially equal to the side length of the inner square and a length substantially double the side length of the inner square. Each inner elongate member may be of U-section, a first side of the U making the hinged connection with the next inner elongate member and the second side of the U having a detent which, when the inner rectangle or square has been formed, retains the inner elongate members in position. Preferably, the second side of the U has a projecting locking tab which enters a respective slot in the side of the U of the next inner elongate member, there being a detent projection which prevents the removal of the locking tab from the respective slot. The detent projection is, further preferably, a bent-out sprag on the locking tab, the sprag facing generally towards the other end of the elongate member. The slot may be much wider than the thickness of the material of the locking tab, in which case the locking tab has at least one bent-out camming tab which engages the side of the slot nearer the hinged connection and thrusts the locking tab against the side of the slot remote from the hinged connection. Preferably, there are two camming tabs, at the top and bottom of the locking tabs, the camming tabs being of triangular shape. Also preferably, the rear end of the camming tab is nearer the other end of the elongated member than the root of the locking tab. The terminal part of the locking tab may be inclined inwards towards the other side of the U.

The invention also provides an openwork screen assembly for use in a building construction, formed of interconnected elongate members with spaces therebetween, and comprising an outer rectangle or square formed by two pairs of parallel, spaced, outer elongate members, and, within and spaced from the sides of the outer rectangle or square, an inner, smaller rectangle or square formed by four inner elongate members, each of which has a first end meeting the next inner elongate member at a position between its ends, to form a T-like shape, and the second end meeting a side of the other rectangle or square between its ends, the inner rectangle or square being thereby surrounded by four intermediate rectangles or squares, a light fitting being associated with at least one of the intermediate rectangles or squares with the axis of the light at a substantial angle to the normal to the assembly. Preferably, the light fitting comprises four sides forming an open rectangular base, there being a notch at each corner of the base, and each side engaging over the respective part of an elongated member forming the respective intermediate rectangle. Each inner elongate member may be of U-section with the base of the U facing the space to be illuminated, the light fitting comprising four sides forming an open rectangular base and which fit over just those sides of the U which are nearer the centre of the respective intermediate rectangle.

The invention further provides a sub-assembly for the above-described openwork screen assemblies which includes four of said inner elongate members with said first end of each inner elongate member making a hinged connection with the next inner elongate member at a position between its ends, the inner elongate members being in collapsed form with all four inner elongate members generally parallel to each other.

The invention also provides a method of erecting an openwork screen assembly in a building construction, which method includes using the above-described assemblies. Preferably, the second elongate members have been preassembled in collapsed form, the method including opening up the inner elongate members to form the inner rectangle or square, and securing said second ends of the inner elongate members to the outer elongate members.

The openwork screen assembly of the invention is particularly suited for use as a suspended ceiling.

Between the inner rectangle or square and the outer rectangle or square, there will be two intermediate rectangles and two intermediate squares, or four intermediate rectangles. A light can be mounted above or behind the rectangle with a beam width (where it passes through the screen assembly) equal to the width of the rectangle and at an inclination as determined by the (greater) length of the rectangle. If there are four intermediate rectangles, the lights can be projected in inclined directions in planes at 90° to each other, giving various possibilities for directing light from a fitting which is above or behind the screen assembly and which can thus remain hidden. In addition, the screen has a novel and interesting appearance, particularly, as is preferred, when the first elongate members form a rectangular or square grid with a number of the outer rectangles or squares, the majority of which are provided with the inner rectangles or squares. It is also found that the shadows cast by the screen assembly are varied and interesting.

Normally such screen assemblies are supplied dismounted, in packs of the elongate members, lying flat against each other. The assembly of the elongate members can be time-consuming, but is normally facilitated by the fact that they form a simple, square grid. The assembly of said inner elongate members would present more problems, but it has been found that they can be hinged together and constructed so that they are delivered in collapsed form with all four elongate members generally parallel to each other, thereby reducing packing density but providing for relatively easy assembly.

BRIEF DESCRIPTION OF THE DRAWINGS

In drawings which, by way of example, illustrate embodiments of the invention:

FIG. 4 is an isometric view showing the interconnection of two blades of a first embodiment of a "windmill section", on a larger scale;

FIG. 5 is a plan view of one of the blades of FIG. 4, part of another blade being indicated in dashed lines;

DETAILED DESCRIPTION OF THE PREFERRED EMBODIMENTS

Figure 1:
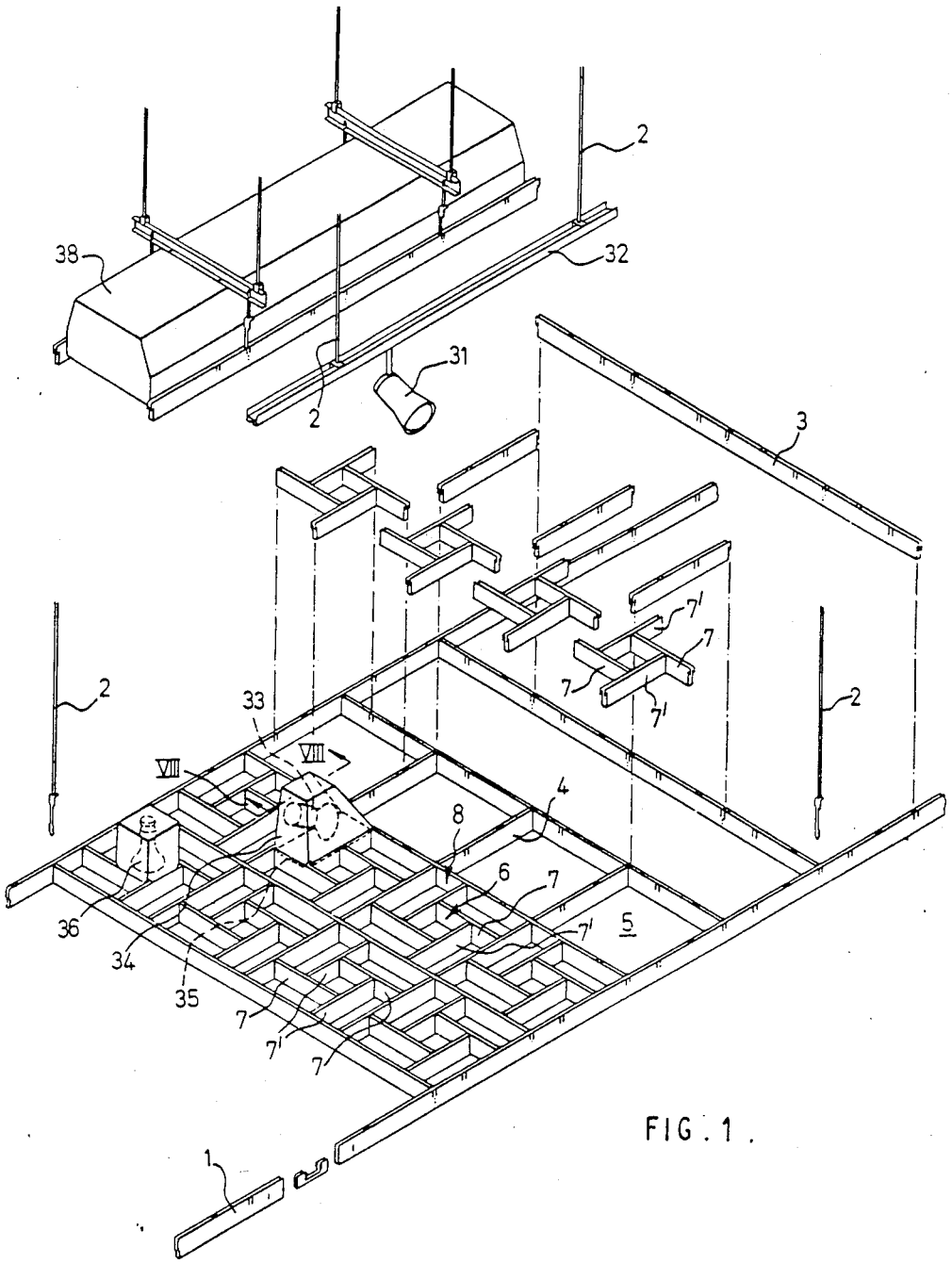
FIG. 1 is an isometric view, partly exploded, of a ceiling system of one embodiment.

The ceiling system of FIG. 1 is formed of hanger runners 1 which are suspended by suspension rods 2, cross-runners 3 hooking into slots in the hanger runners 1, and shorter cross-runners 4 hooking into slots in the cross-runners 3. The runners 1, 3 and 4 are elongate channel members of U-shaped cross-section with the bases of the U's at the bottom, and can be cold-formed from aluminium or other sheet material and are therefore relatively lightweight.

As can be seen, the runners 1,3,4 form a square grid with a number of cells or squares 5. Some of these squares can serve to accommodate larger light fittings, or runners may be omitted to accommodate even larger light fitting such as the fitting 38 indicated in FIG. 1. However, the majority of the squares 5 are provided with inner squares 6 formed by four lightweight inner blades 7,7'. Each blade 7,7' has a first end meeting the next blade 7',7 substantially at its mid-point and thereby forming a T-shape. The other end of the blade 7,7' meets a side of the outer square 5 between its ends. In this way, the inner square 6 is surrounded by four intermediate rectangles 8 whose length is approximately double the side length of the inner square 6 and whose width is approximately equal to the width of the inner square 6. The shape formed by the four blades 7,7' is termed a "windmill section" herein. The blades 7,7' have the same cross-sectional shape and construction as the runners 1, 3 and 4.

In detail, the windmill sections can be inserted after the main grid has been assembled, and said second end of each blade 7,7', like the cross-runners 3 and shorter cross-runners 4, has hooks for hooking in slots in the outer runners 1, 3 or 4. This enables the windmill section to be secured in place without difficulty.

Figures 2, 3:
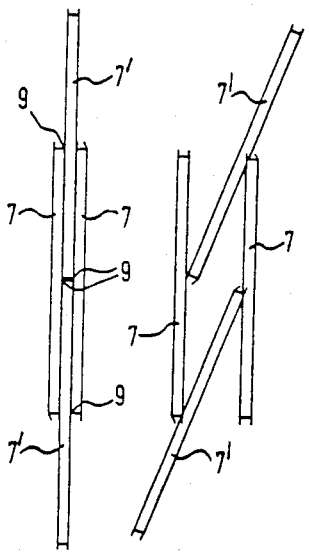
FIGS. 2 and 3 are views of a "windmill section" in its fold-flat configuration a open configuration, in plan view.

The construction of the inner blades 7,7' is such that the windmill sections are pre-assembled in collapsed form with all four blades 7,7' substantially parallel to each other. As shown in FIG. 2, two opposite blades 7' are aligned and the other two opposite blades 7 are on either side of the aligned blades 7' and overlapping each of them. The connections 9 between the blades 7 are hinged connections so that the inner square 6 is opened up by pivoting the blades 7 relative to one another about the hinged connections 9. FIG. 3 shows the windmill section partly open; opposite blades 7,7 and 7',7' are identical, but adjacent blades 7,7' are mirror images.

As shown in FIG. 4, each hinged connection 9 is formed by a projecting hinge tab 10 on the first end of the blade 7,7'. Intermediate its top and bottom and on its outer side, the hinge tab 10 has a bent-out sprag 11, directed generally towards the outer end of the inner elongate member. The tab 10 is engaged in a slot 12 in the next blade 7',7. The top and bottom end portions of the slot 12 are tooled so as to be close to the respective sides of the tab 10, but the middle portion of the slot 12 is formed by rolling back a long lip 13. It will be seen that the sprag 11 engages behind the side of the slot opposite the lip 13. In the lie-flat configuration of the windmill section (FIG. 2), the tabs 10 or the associated part of the adjacent blade will be slightly distorted and not strictly coplanar with the remainder of the respective side of the U, but the inherent flexibility of the material permits such distortion.

As the windmill sections are retained in position by hooking the second ends of the blades 7,7' into the slots in the cross-runners 3 and shorter runners 4, it is not necessary to provide any other means such as detents for maintaining the windmill sections in their proper configuration. However, some such detents make assembly easier. As shown, while one side of the blade 7,7' makes the hinged connection 9, the other side of the blade 7,7' has a projecting locking tab 14 which enters a slot 15 in the side of the next blade 7',7 forming a detent for retaining the blades 7,7' in their open position. In order to ensure that the tip of the tab 14 does not foul the sides of the slot 15, the slot 15 is much wider than the thickness of the material of the tab 14; in addition, the tab 14 is inclined inwards towards the other side of the blade 7,7', for instance at 35°. The tab 14 has a detent projection in the form of a bent-out sprag 16, the sprag 16 facing generally towards the other end of the elongate member 7,7'. In order to thrust the tab 14 against the side of the slot remote from the hinged connection 9 or hinged tab 10, there are two camming tabs 17, at the top and bottom of the locking tab 14. Each camming tab is of triangular shape and the arrangement is such that, due to inclining the locking tab 14 inwards, the apex or rear end of each camming tab 17 is nearer the other end of the blade 7,7' than the root of the locking tab 14. This, as indicated in FIG. 5, prevents the next blade 7 (or 7') from riding over the ends of the camming tabs 17.

Figure 6:
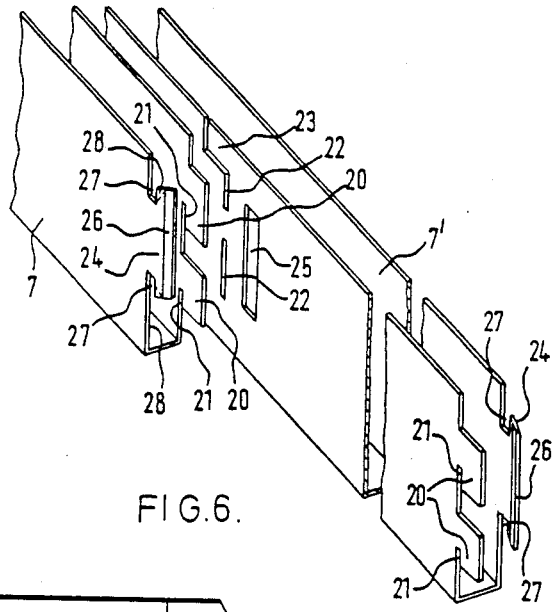
FIG. 6 is an isometric view showing the interconnection of two blades of a second embodiment of a "windmill section"

In FIG. 6, each hinged connection 9 is formed by two projecting hinge tabs 20 (one tab 20 would be sufficient) on the first end of the blade 7,7', each tab 20 having a slot 21 in one edge to form a hook. The tab 20 is engaged in and hooked over the edge of a slot 22 in the next blade 7',7. The upper slot 22 has one end effectively closed by a tab 23 formed in the blade 7,7' and generally in the plane of the blade 7,7'.

Prior to hooking the blade 7,7' into place, the tab 23 was bent out of the plane of the side of the other blade 7',7 to allow the tab 20 to be hooked into position; the tab 23 was then bent back to retain the hinged connection and to stop the first blade 7,7' lifting up out of position.

In the lie-flat configuration of the windmill section (FIG. 2), the tabs 20 will be slightly distorted and not strictly coplanar with the remainder of the respective side of the U.

Figure 7:
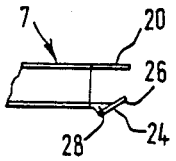
FIG. 7 is a plan view of the end of one of the blades of FIG. 6.
Figure 8:
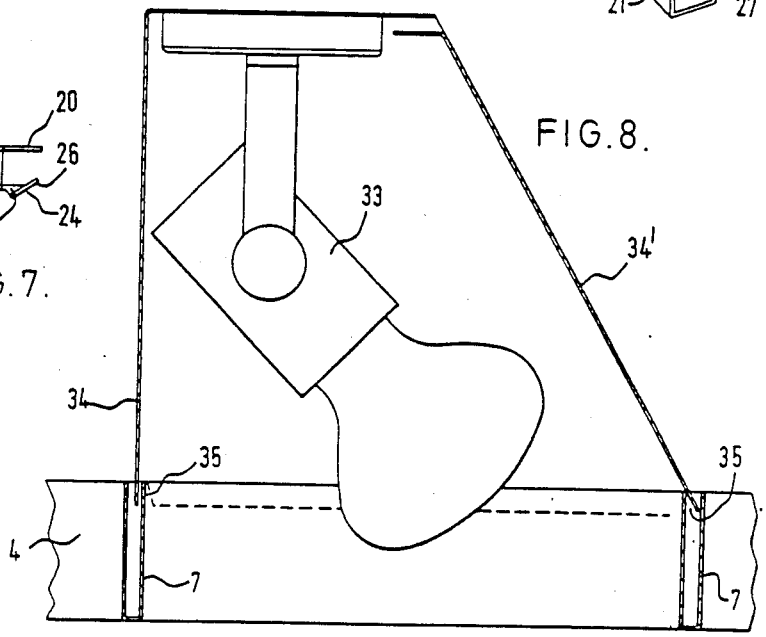
FIG. 8 is a scrap vertical section, on a larger scale, along the plane VIII—VIII indicated in FIG. 1.

The other side of the blade 7,7' has a projecting locking tab 24 which enters a slot 25 in the side of the next blade 7',7. The terminal part 26 of the tab 24 is bent at about 30° out of the plane of the side of the blade 7,7' and is inclined inwards towards the other side of the blade 7,7'. The two opposite edges of the tab 24 are slit at 27 and parts of the tab 24 remote from the end of the tab 24 are bent outwards to form generally triangular detent projections 28. The ends of the detent projections 28 are substantially aligned with the terminal part 26, as can be seen in FIG. 7. As the tab 24 is inserted through the slot 25, the detent projections ride against the side of the slot 25 and are elastically deformed without causing any permanent damage. When the tab 24 is fully home, the detent projections 28 spring back and retain the windmill section in its proper configuration.

FIG. 1 shows a light fitting 31 carried on a bar 32 by suspension rods 2. This light fitting 31 is for association with one of the intermediate rectangles 8 with the axis of the light at a substantial angle to the vertical.

FIG. 1 also illustrates an alternative or additional arrangement. In this case, the light fitting 33 is inclined, like the light fitting 31, but includes a box having four sides 34,34' forming a rectangular shape (see FIG. 5). There is a notch 35 at each corner of the rectangle, and at least each of the end sides 34,34' engages over the respective side of e.g. a blade 7,7' forming the respective intermediate rectangle 8. Thus the light fitting 33 fits over just those sides of the U-section which are nearer the centre of the rectangle 8. This greatly reduces any leakage of light. The dimensions and shape of the box are arranged so that the box can be pushed up from below while it is inclined so that the sloping side 34' is roughly vertical; the box is then lowered so that the end sides hook over the blades 7. The long sides can flex in slightly and then spring out to give a flush fit against the respective blade or runner. The box is preferably formed of aluminium. FIG. 1 also illustrates a vertical light fitting 36 in an inner square 6, as an alternative or addition.

In a preferred construction, the inner squares 6 are 100×100 mm, the intermediate rectangles 8 are 100×211 mm and the module is 330 mm. The actual proportions of the inner square 6 and intermediate rectangles 8 have been chosen for the aesthetic effect; the inner squares 6 could be larger and the rectangles 8 narrower and longer, or vice versa.

In the appended claims the word "rectangle" or "rectangular" is intended to have its usual meaning, that is, a parallelogram having four right angles. Thus, a square is a rectangle.

What I claim is:

1. An open work screen assembly for use in a building construction, formed of interconnected elongate member with spaces therebetween, comprising:

an outer rectangle formed by two pairs of parallel, spaced, outer elongate members, and an inner rectangle smaller than said outer rectangle inside and spaced from said outer rectangle, formed of four serially adjacent inner elongate members, each of said four elongate members having opposite free ends including a first free end meeting the next inner elongate member at a position between its opposite free ends to form a T-shape, and a second free end opposite said first free end meeting a side of the outer rectangle between its ends, the inner rectangle being thereby surrounded by four intermediate rectangles, the first end of each inner elongate member making a hinged connection with the next inner elongate member, said inner elongate member including at last one projecting hinge tab on said first end thereof projecting generally longitudinally of said inner elongate member, the next inner elongate member having at least one slot extending generally transversely to the direction of elongation of said next inner elongate member, each slot being defined by edges on said next inner elongate member substantially surrounding the slot, said at least one hinge tab being retained in said at least one slot so as to define said hinge connection, said edges surrounding the tab, said four inner elongate members being formed so as to be serially hingedly connectable to each other at said hinged connections in a collapsed condition with all four inner elongate members generally parallel to each other such that the inner rectangle is openable by pivoting said inner elongate members relative to one another about the hinged connections.

2. An open work screen assembly for use in a building construction, formed of interconnected elongate members with spaces therebetween, comprising:

an outer rectangle formed by two pairs of parallel, spaced, outer elongate members, and an inner rectangle smaller than said outer rectangle inside and spaced from said outer rectangle, formed of four serially adjacent inner elongate members, each of said four elongate members having opposite free ends including a first free end meeting the next inner elongate member at a position between its opposite free ends to form a T-shape, and a second free end opposite said first free end meeting a side of the outer rectangle between its ends, the inner rectangle being thereby surrounded by four intermediate rectangles, the first end of each inner elongate member making a hinged connection with the next inner elongate member, said inner elongate member including at least one projecting hinge tab on said first end thereof projecting generally longitudinally of said inner elongate member, the next inner elongate member having at least one slot extending generally transversely to the direction of elongation of said next elongate member, each slot being defined by edges on said next elongate member completely surrounding the slot, said at least one hinge tab being retained in said at least one slot so as to define said hinge connection, said edges surrounding the tab, said four inner elongate members being formed so as to be serially hingedly connectable to each other at said hinged connections in a collapsed condition with all four inner elongate members generally parallel to each other such that the inner rectangle is openable by pivoting said inner elongate members relative to one another about the hinged connections, each inner elongate member being pivotable between a first angular orientation in which the inner elongate member is parallel to the next inner elongate member and a second angular orientation in which the inner elongate member extend perpendicularly to said next inner elongate member, said inner elongate member having a first side which faces said next inner elongate member when said inner elongate member is in said first angular orientation and a second side opposite said first side, said tabs and said slots each extending from respective top ends to respective bottom ends in planes extending perpendicularly to the plane of said outer rectangle, said tabs each having a bent-out sprag, directed generally toward the second end of the inner elongate member, located intermediate the top and bottom of the inner elongate member at said first side, for engaging said next inner elongate member to retain the hinge tab in the slot.

3. The assembly of claim 1, 1 or 2, in which the inner elongate members are constructed so that they can be collapsed with all four inner elongate members substantially parallel, two opposite inner elongate members being aligned and the other two opposite inner elongate members being on either side of the aligned inner elongated members and overlapping each of them.

4. The assembly of claim 1, 1 or 2 wherein said first end of the inner elongate member makes a hinged connection with substantially the mid-point of the next inner elongate member, thereby forming an inner square surrounded by intermediate rectangles having a width substantially equal to the side length of the inner square and a length substantially double the side length of the inner square.

5. An open work screen assembly for use in a building construction, formed of interconnected elongate members with spaces therebetween, comprising:

an outer rectangle formed by two pairs of parallel, spaced, outer elongate members, and an inner rectangle smaller than said outer ractangle inside and spaced from said outer rectangle, formed of four serially adjacent inner elongate members, each of said four elongate membes havign a U-shaped cross section, and opposite free ends, including a first free end meeting the next inner elongate member at a position between its opposite free ends to form a T-shape, and a second free end opposite said first free end meeting a side of the outer rectangle between its ends the inner rectangle being thereby surrounded by four intermediate rectangles, the first end of each inner elongate member making a hinged connection with the next inner elongate member on a first side of the U of the U-shape cross section, a second side of the U opposing the first side and the next inner elongate member together comprising a detent releasably retaining the inner elongate members in position with said four inner elongate members forming said inner rectangle, said four inner elongate members being formed so as to be serially hingedly connectable to each other at said hinged connections in a collapsed condition with all four inner elongate members generally parallel to each other such that the inner rectangle is openable by pivoting said inner elongate members relative to one another about the hinged connections.

6. The assembly of claim 5, wherein said detent comprises a projecting locking tab on the second side of the U, and a respective slot in a side of the U of the next inner elongate member said tab removably projecting into the respective slot, said tab including a detent projection which releasably blocks the removal of the locking tab from the respective slot.

7. The assembly of claim 6, wherein the detent projection is a bent-out sprag on the locking tab, the sprag facing generally towards the said second end of the elongate member.

8. The assembly of claim 6, wherein the slot is much wider than the thickness of the material of the locking tab, the locking tab having at least one bent-out camming tab which engages the side of the slot nearer the hinged connection and thrusts the lcoking tab against the side of the slot remote from the hinged connection.

9. The assembly of claim 8, wherein there are two camming tabs, at the top and bottom of the locking tabs, the camming tabs being of triangular shape.

10. The assembly of claim 8 or 9, wherein the rear end of the camming tab is nearer the other end of the elongated member than the root of the locking tab.

11. The assembly of any one of claim 6 to 8, wherein at least the terminal part of the locking tab is inclined inwards towards the other side of the U.

* * * * *